United States Patent [19]

Ando et al.

[11] 3,976,484

[45] Aug. 24, 1976

[54] SCREEN ELECTROPHOTOGRAPHIC PROCESS

[75] Inventors: Yujiro Ando, Yokohama; Katsunobu Ohara; Keiji Tanaka, both of Kawasaki, all of Japan

[73] Assignee: Canon Kabushiki Kaisha, Tokyo, Japan

[22] Filed: May 14, 1974

[21] Appl. No.: 469,892

[30] Foreign Application Priority Data

| | | |
|---|---|---|
| May 23, 1973 | Japan | 48-57389 |
| June 19, 1973 | Japan | 48-69344 |
| Nov. 9, 1973 | Japan | 48-126038 |

[52] U.S. Cl. ..... 96/1 R; 355/35; 250/315 R

[51] Int. Cl.[2] ..... G03G 13/22

[58] Field of Search ..... 96/1 R; 355/3 R, 35 C

[56] References Cited

UNITED STATES PATENTS

| | | | |
|---|---|---|---|
| 3,645,614 | 2/1972 | McFarlane et al. | 355/3 R |
| 3,680,954 | 8/1972 | Frank | 355/3 R |
| 3,694,200 | 9/1972 | Pressman | 96/1 R |
| 3,773,417 | 11/1973 | Pressman et al. | 355/3 R |
| 3,797,926 | 3/1974 | Fotland et al. | 96/1 R X |
| 3,809,556 | 5/1974 | Pressman et al. | 96/1 R |
| 3,839,027 | 10/1974 | Pressman | 96/1 R |

*Primary Examiner*—Roland E. Martin, Jr.
*Attorney, Agent, or Firm*—Fitzpatrick, Cella, Harper & Scinto

[57] ABSTRACT

This invention provides an electrophotographic process for forming an image using a photosensitive screen having a plurality of fine openings. The screen has a conductive material on which a photoconductive material is provided, wherein at least a part of the conductive material remains exposed. The peripheries of the openings of the screen are capable of retaining charges as a result of an image exposure to form a primary electrostatic latent image on the screen.

11 Claims, 13 Drawing Figures

SCREEN ELECTROPHOTOGRAPHIC PROCESS

BACKGROUND OF THE INVENTION

1. Field of the Invention

This invention relates to an electrophotographic process, and more particularly to such a process for forming an image using a photosensitive plate having a number of openings.

2. Description of the Prior Art

As the typical conventional electrophotography, a direct process such as for example electrofax and an indirect process such as xerography are presented. In the former direct process, use is made of a specifically treated recording material coated with a photoconductive material such as zinc oxide. Consequently, there is a drawback in the image contrast as the image formed on the recording material lacks brightness. Moreover, due to the specific treatment, the recording material is heavier than conventional paper and has a different feed from the usual paper. According to the latter indirect process, a high contrast and high quality image is obtained as it uses conventional paper as the recording material to form an image. However, in this indirect process, when a toner image is transferred to the recording material, the recording material contacts with the surface of the photosensitive member and cleaning means are required to make contact, with the surface of the photosensitive member when the remaining toner is cleaned, so that the photosensitive member deteriorates each time the transfer and the cleaning is applied. Therefore, the useful life of an expensive photosensitive member becomes shortened which results in a high cost for forming an image.

The improvements for removing said drawbacks of the conventional processes were disclosed in, for example, U.S. Pat. Nos. 3,220,324; No. 3,680,954 and No. 3,645,614. In these patents, a photosensitive member of a screen type or a grid type is used which has a number of fine openings. The electrostatic latent image is formed on a recording material by modifying ion flow through the screen or grid, and thereafter the latent image formed on the recording material is visualized. There is no necessity to develop and clean the screen or grid which corresponds to the photosensitive member, so that the useful life of the screen or grid is prolonged.

In U.S. Pat. No. 3,220,324, a conductive screen coated with a photoconductive material is used, and an image exposure is made simultaneously with corona ion flow from the corona discharger so that ions are applied to a recording material through said screen. The corona ion flow is modified by the screen and an electrostatic latent image is formed on the recording member. In this process, the charging of the screen and the image exposure are simultaneously made and it is difficult to charge the photoconductive material to a sufficiently high potential. Therefore the exposure efficiency of an image is deteriorated and it is difficult to obtain a high quality copied image. Further, at the dark portion of the image where ions are passed, when the potential of the screen is raised too high, the applied corona ion is repulsed so that the corona ion is directed toward the light portion in the vicinity of the dark portion of the screen and the good image is difficult to obtain.

According to U.S. Pat. No. 3,680,954, a conductive grid coated with a photoconductive material and a conductive controlling grid are used, an electrostatic latent image is formed on the grid in the image form, and the different electric fields are formed on the grid and the controlling grid so as to modify the corona ion flow to form an image on a recording member. In this process, however, it is quite difficult to hold the controlling grid and the photoconductive grid to provide proper spacing therebetween over a large area. Moreover, the controlling grid absorbs corona ions which would be applied to the recording member so that, the efficiency becomes deteriorated. In case of an attempt at forming a positive image, corona on flow having a polarity opposite to the polarity of the latent image is applied, and almost all of this ion flow directs to the latent image to negate the latent so that it is difficult to reproduce the positive image.

In U.S. Pat. No. 3,645,614, the screen comprises an insulating material overlaid with a conductive material wherein the insulating material comprises a photoconductive material. An electric field preventing the passing of ion flow is formed at the openings corresponding to the electrostatic latent image formed on the screen. In this process, it is a drawback that an image obtainable on the recording member is the image reversal of the latent image on the screen.

SUMMARY OF THE INVENTION

It is a primary object of this invention to provide an electrophotographic process capable of forming a copied image on the various kinds of the recording members.

Another object of the invention is to provide an electrophotographic process overcoming the drawbacks of the prior art and capable of easily obtaining a positive image of the original image under a high illuminating efficiency of the original.

A further object of the invention is to obtain a high contrast and high quality image having no blur.

These and other objects of the invention will be apparent from the following description.

The screen to be used in the invention has a plurality of fine openings. The screen comprises a conductive member provided with a photoconductive member, at least a portion of the conductive member being exposed at one side of the screen. In the vicinity of the openings, charges are retained when the image exposure is applied. On the screen, precharging and image exposure are applied, and then ion flow is applied to a recording member through the screen.

DETAILED DESCRIPTION OF PREFERRED EMBODIMENT

Figure 1:
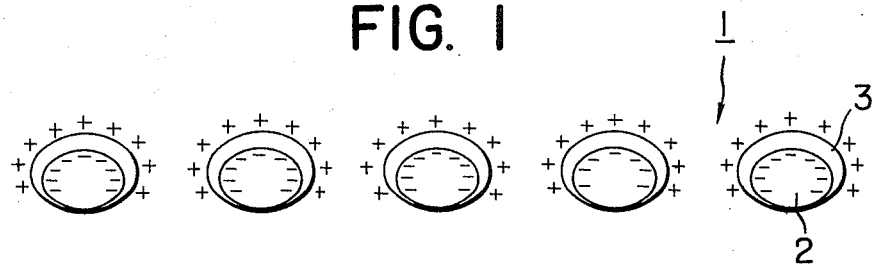
FIGS. 1 through 3 explain the steps of the electrostatic latent image forming process according to the electrophotographic process of the invention.

The invention is described referring to the embodiment shown in the drawing. The primary electrostatic latent image refers to the electrostatic latent image formed on the screen according to the predetermined process of the invention. The secondary electrostatic latent image is the image formed on the chargeable recording member by ion flow controlled by the primary latent image.

Figure 2:
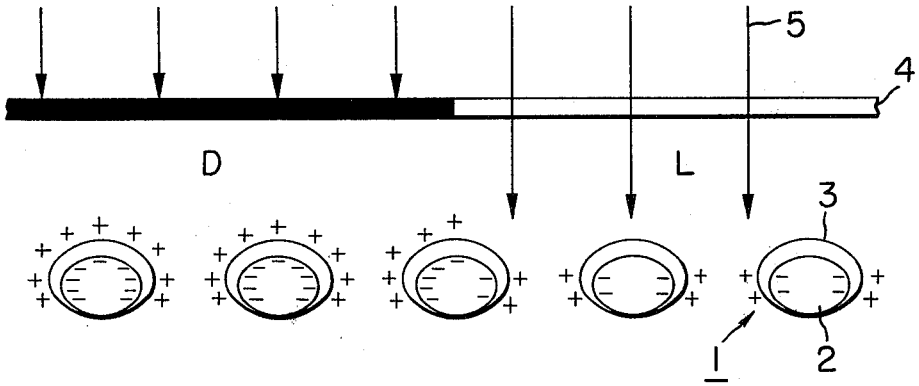
Figure 3:
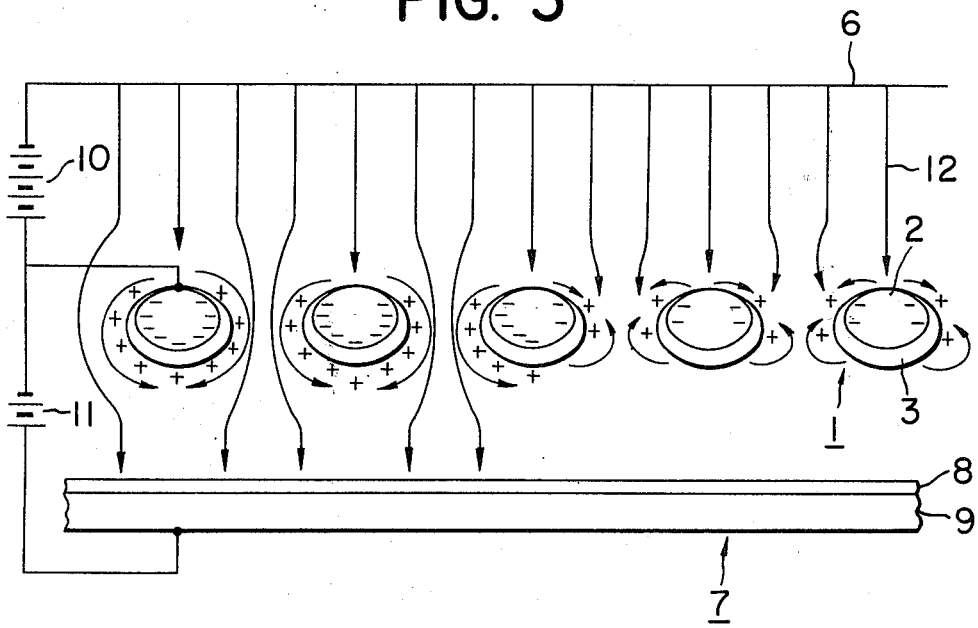

FIGS. 1 through 3 show an example of the steps for forming an electrostatic latent image of the invention. FIG. 1 shows the step of precharging of the screen, FIG. 2 shows an image exposure step, and FIG. 3 shows the step for forming the secondary electrostatic latent image. In FIG. 1 the conductive member 2, which forms the base of the screen 1, is prepared either by etching or electroplating a metallic plate of silver, copper or brass or the like to form a good number of fine openings therein, or by weaving in net-shape the fine conductive wires of said metal. In case of using a screen for electrophotographic copying performed in offices, a 100 to 400 mesh screen is appropriate. On the conductive member 2, including the surfaces of the openings, there is formed by spraying, vacuum evaporation or sputtering from one side thereof, a layer either of resin binded inorganic photoconductive substance such as selenium, selenic alloy, zinc oxide, CdS, or lead oxide, etc., or of a photoconductive member 3 of an organic photoconductive substance. In said screen 1, each of the conductive member 2 is electrically continuous, and at one side of the screen 1, a portion of the conductive member 2 is exposed; i.e., not covered with the photoconductive member 3. To the screen 1 having the structure mentioned above, the precharge is applied preferably from the side of the photoconductive member 3 with a polarity suitable for the characteristic of the photoconductive member 3. As means for precharging, a corona discharger is suitable, however, a conventional charging means such as a roller electrode is usable. By this precharging, as shown in the drawing, the charging side and the openings of the screen 1 are charged by the corona discharger. FIG. 1 shows an example in which the screen 1 is charged in positive polarity by corona wires of the corona discharger, but it is possible to charge in negative. Further, the precharging can be applied simultaneously from both sides of the screen 1.

FIG. 2 shows the step to expose the image of an original on the precharged screen. In this step, either slit exposure or whole surface exposure is applied using transmitting light or reflecting light through the original. In usual copying machines, visible light rays are used for the light source of the exposure, but radiation rays such a ultra-violet rays, X rays or infrared rays to which the photoconductive member 13 is activated may be used. In the drawing, the transmitting light ray exposure is used to expose the screen to the original image. In FIG. 2, the original is designated by the reference numeral 4, the arrow 5 shows the light from a light source and D shows a dark area while L shows a light area. By the image exposure, in light area L of the photoconductive member 3 of the screen 1, the resistance decreases, and the charge on the surface disappears. On the other hand, the charge on the photoconductive member 3 in the vicinity of the openings at the light area L remains since the light amount at this portion is small. The resistance at the dark area D of the photoconductive layer 3 of the screen 1 is unchanged, and the charge due to the precharge is remained as it is. By the precharge step and the exposure step, the primary electrostatic latent image in accordance with the original image is formed on the screen 1. For forming the primary latent image, said two steps are applicable simultaneously or in reverse order according to characteristic of the substance of the photoconductive member 3 of the screen 1.

FIG. 3 shows the step for forming the secondary electrostatic latent image on a recording member utilizing the primary latent image formed on the screen 1 according to the aforementioned steps. In this figure, 6 is corona wire of the corona discharger, 7 is a recording member, which consists of a conductive base 9 and a thin chargeable layer 8 of, for example, an insulating material. In this step, ion flow is applied to the recording member 7 through the screen 1 having the primary electrostatic latent image. An ion flow having a polarity opposite to that of the precharge is suitable and is obtained by the corona discharge of D.C. or A.C. from the corona wire 6. In FIG. 3, negative corona discharge is applied. In this case, with the aid of electric sources 10 and 11, the potential in the positive direction becomes stronger nearer to the recording member 7 from the wire 6. At the light area L of the photoconductive member 3 of the screen 1, the electric field preventing the negative ion flow is formed between the portion of the surface of the member 3 where the charge exists and the portion where the charge does not exist. On the other hand, at the dark area D of the member 3, the charge exists throughout the surface thereof and the electric field preventing the corona ion flow does not exist. The electric field affecting the ion flow is shown by the electric force lines 12. In FIG. 3, the force lines are shown from the negative potential to the positive potential contrary to the conventional case, so that the corona ion moves along the arrow direction. Consequently, the corona ion flow from the corona wire 6 at the dark area D of the screen 1 reaches the recording member 7 attracted by the bias potential applied to the conductive base 8. In the light area L of the screen 1, all ion flow flows into the exposed conductive member 2 and at the vicinity of the openings ion flow is impeded and does not arrive at the recording member 7. As the result, the secondary electrostatic latent image in accordance with the primary electrostatic latent image in accordance with the primary electrostatic latent image on the screen 1 is formed on the member 7.

It is also possible to form the secondary electrostatic latent image by applying A.C. to the wire 6 instead of discharging corona ion flow of one polarity from the wire 6. In this case, ions having the polarities of negative and positive reach the screen 1, but due to the bias actuation of the electric source 11, only the negative corona ion flow reaches the recording member 7. Therefore, as as in the case of applying negative D.C. corona discharge, a high quality secondary latent image is formed. By using A.C. corona discharge, the effective current which is the balance between the positive current and negative current of A.C. is decreased. In the vicinity of the openings of the screen corresponding to the light area of the original image, when negative and positive currents are applied, the charge at the openings is more difficult to be dissipated than in case of applying D.C. corona ion flow. At the light area L, ion flow is prevented, and a foggyless secondary latent image is formed on the according member. Therefore, the visualized secondary image has a high and clear contrast. In case of A.C. corona discharge, for regulating the ratio of the negative and positive components of the current applied to the corona discharging electrode, it is possible to add a suitable bias voltage to the A.C. or to insert an electric resistor into either component.

The negative image is obtained by the electrophotographic process of this invention in the following steps. When the polarities of the sources 10 and 11 are reversed, in either of the light and dark areas, the electric fields to direct the positive corona ions to the exposed conductive member 2 of the screen 1 are formed. Therefore the positive corona ion can not pass through the screen 1. However, by weakening the precharge to the screen 1, or increasing the light amount of the original image exposure, or uniformly exposing from the side of the conductive member 2 of the screen 1, or applying A.C. corona discharge, or applying corona discharge of a polarity opposite to the precharge, the electric field of the light area of the screen 1 disappears so as to enable the passage of the positive corona ions to form the negative image of the original. The corona discharge used for forming the secondary electrostatic latent image may be D.C. or A.C.

The screen 1 must satisfy the following conditions. On the side of the screen 1 where the corona discharger for forming the secondary latent image is located, the insulating material comprising a photoconductive insulating material must not coat the entire conductive member 2. The reasons for this are as follows. Firstly, the ion flow passing through the screen 1 may be of a very small amount, however, since the corona ion flow produced by the corona discharger may be more than several ten times the said ion flow, the excess current more than the necessary amount should be removed before it arrives at the member 7 for obtaining the stable image. Namely, the conductive member 2 of the screen 1 is exposed to the corona discharging electrode, ion flow into the member so that the excess amount of the current can be removed. Secondly, during corona ion flow, the insulating material is firstly charged, which removes the primary electrostatic latent image on the photoconductive member 3 of the screen 1 in a short time. And in a certain case, the foggy secondary latent image is obtained, since the charge in a polarity of ion flow is formed so as to promote the passage of the ion flow. In case of applying A.C. corona ion flow at the formation of the secondary latent image, the insulating material is not charged so said condition is not necessary.

Figure 4:
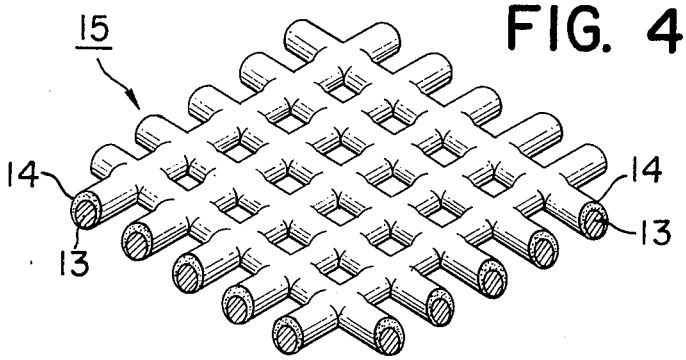
FIGS. 4 and 5 show an enlarged perspective view of an embodiment of the screen used in the invention.
Figure 5:
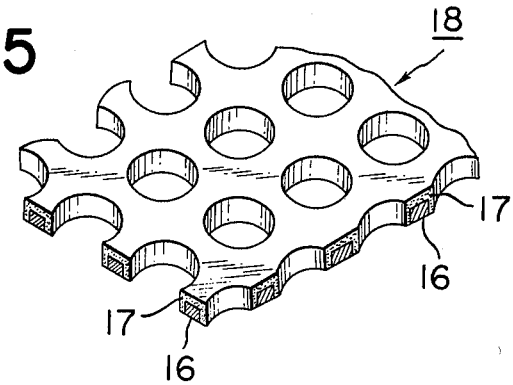

FIGS. 4 and 5 show enlarged perspective views of the screens, respectively, usable for the process of this invention. FIG. 4 shows the screen 15 comprising the conductive base 13 of the conductive fine wires of stainless steel etc., coated with the photoconductive member 14. FIG. 5 shows the screen 18 comprising the conductive plate of for example copper provided with a plurality of fine openings, the member 16 being coated with the photoconductive member 17.

Figure 6:
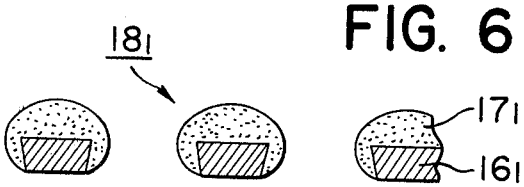
FIGS. 6 and 7 show an enlarged cross sectional view of the screen suitable for the invention.
Figure 7:
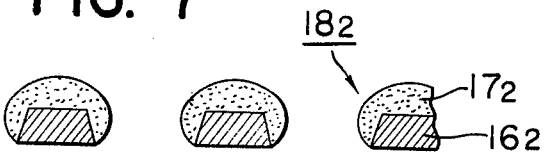

FIG. 6 and 7 explain the process to prepare the member 16 by etching. FIGS. 6 and 7 show cross sections of the screen 18. In these figures, the trapezoid of the screen 18 is the conductive member 16, which is formed by the oxidation of the oxidizing agent in case of etching the metallic plate. The photoconductive member 17 is coated on the member 16 surrounding the side of the member 16 as shown in the drawing. This is so made by the evaporation from the inclined direction or by utilizing the effect of scattering of the evaporating substance due to the remaining gaseous molecules. In the case of FIG. 6, the portion of the opening of the screen 181 in the exposure step becomes the shade of the conductive member 161 so that the charge at that portion remains. Consequently, the stable and high quality copying image is obtained when the present process is applied to the screen 181 shown in FIG. 6. When the screen 182 is as shown in FIG. 7 where the photoconductive member 172 is provided at one side surface of the conductive member 162 is used, the charge on the photoconductive member 172 due to the precharge is dissipated by the image exposure, and it is difficult to obtain a foggyless image. This also shows the fact that the charge on the surface of the photoconductive member at the side surface of the screen where the corona ion passes will control the corona ion flow. For obtaining a good copied image by using the screen 182, the exposure light amount should be reduced to one half or one third of that used for the screen 181. By so doing, the secondary latent image is obtained although it still tends to be a foggy image due to the difference in the charge amounts at the leading edge and the side surface of the photoconductive member 172.

In the foregoing descriptions, the secondary latent image is formed on the recording member 7 faced to the side of the screen 1 where the image exposure is made.

The following is the description in case of disposing the recording member 7 faced to the side of the screen opposite to the exposure side. When the secondary latent image is formed by applying the corona ion flow from the exposure side, the weak corona discharge of the same polarity as that of the primary latent image is applied, the second latent image thus formed on the member 7 is a negative image of the primary latent image. This may be caused by the fact that the corona ions can not be passed at the dark area due to the repulsion by the charge on the dark area of the same polarity of the screen 1 so that the negative second latent image is formed on the recording member 7. Next, when the corona discharge of a polarity opposite to the primary latent image on the screen 1 is applied, unclear negative secondary latent image or a low contrast positive latent image is formed. The corona ion flow of a polarity opposite to the precharge is attracted to the charge on the dark area of the screen 1, but in the vicinity of the openings of the screen 1 the preventing electric field is formed, and the secondary latent image becomes an unclear negative or low contrast positive image. Further, in case of the recording material facing the side of the screen opposite to the side to which the exposure is applied, and when the screen is formed in endless form such as drum or web, the optical system or the recording member must be placed inside of the screen, which tends to make the apparatus, complex and bulky.

The example of forming the latent image of this invention is described hereinafter.

The screen is formed by using the net formed by 200 mesh stainless steel wires. The amorphous selenium is coated on the net by vacuum evaporation, the maximum thickness of the coating is 60 $\mu$. The corona discharge of +6KV is applied in the dark to the photoconductive layer of selenium to uniformly charge it in positive polarity.

The photoconductive layer is image exposed in about 0.2 second by a 10 lux tungsten lamp. Then from the side opposite to the side of the image exposure, the corona discharge of −6KV, which is a polarity opposite to that of the precharge, is applied by the corona discharger to the recording member through the screen. The space between the screen and the recording member is 3 mm, and the screen is grounded while the +2KV is applied to the recording member.

The latent image thus formed on the recording member is visualized by the liquid developing method. The visible image is foggyless having high contrast and high quality.

Figure 8:
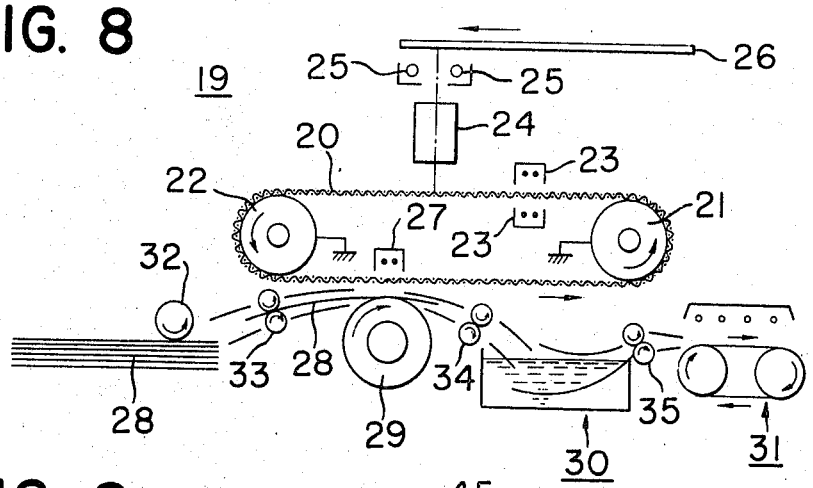
FIGS. 8 and 9 show a device applying the electrophotographic process of the invention.
Figure 9:
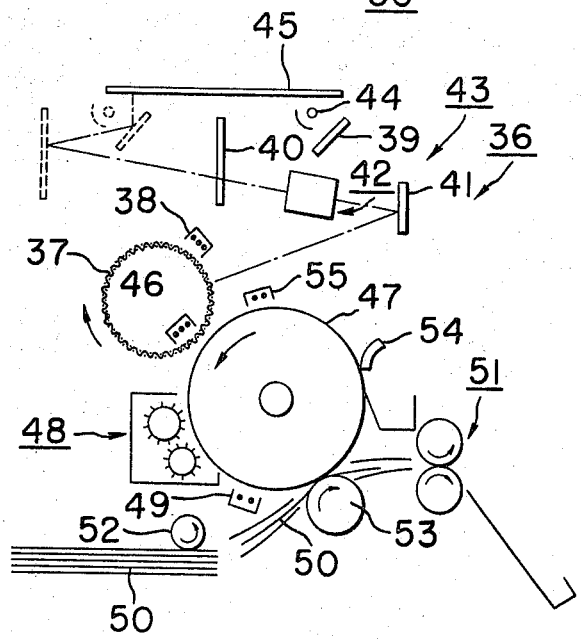
Figure 10A:
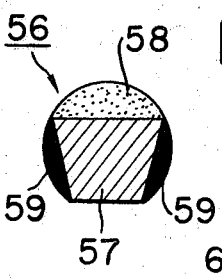
FIG. 10 shows an enlarged cross section of an improved screen for use in the electrophotographic process shown in FIGS. 1 through 3.
Figure 10B:
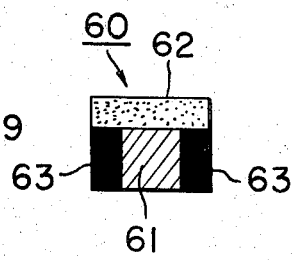
Figure 10C:
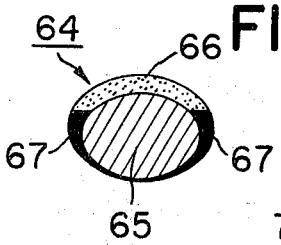
Figure 10D:
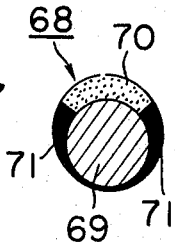

FIGS. 8 and 9 show an apparatus embodying the electrophotographic process of this invention. In The electrophotographic apparatus 19 shown in FIG. 8, the screen 20 is an endless web having the outside thick photoconductive layer and the inside layer where the conductive member is uncovered. The screen is wound around the ground conductive rollers 21 and 22 so that the conductive member of the screen makes contact with the rollers 21 and 22. The screen rotates in the arrow direction by means of a driving device. The screen 20 is precharged by the corona discharger 23, and then is exposed to the light image of the original 26 through the optical system 24 with the aid of the screen where the thick photoconductive layer exists. The screen 20 thus formed with the primary latent image is received the corona ion flow of a polarity opposite to the precharge by the corona discharger 27 located inside of the screen web to modify it onto the recording member 28, which is moved synchronously with the screen 20. The secondary latent image is formed on the recording member at the conductive roller 29 applied with a bias voltage and disposed oppositely to the corona discharger 27 relative to the screen 20. The latent image on the member 28 is developed by the developer 30 and fixed by the fixing means 31 to complete the copied image. The roller 32 is used for feeding the recording paper 28 and the rollers 33, 34 and 35 are used to transfer the paper 28. In the apparatus of FIG. 8, the secondary latent image is formed directly on the recording member or paper.

The modified apparatus shown in FIG. 9 differs from the apparatus shown in FIG. 8 in that the secondary latent image is not directly formed on the recording member. In the apparatus 36 shown in FIG. 9, screen 37 if formed in drum type so that the exposed surface of the conductive member is located on the inner side of the screen 37. The screen 37 rotates in the arrow direction by means of a driving system. The screen 37 receives a precharge from the side of the photoconductive layer by means of the precharging corona discharger 38, and then a light image exposure of the original 45 from the side of the precharged surface through the optical system 43 comprising wires 39, 40 and 41 and lens 42 under the illumination of the lamp 44. The primary electrostatic latent image thus formed receives corona ion flow of a polarity opposite to that of the precharge by the corona discharger 46, so that the secondary latent image is formed on the drum 47 having an insulating surface and located opposite to the discharger 46. A predetermined voltage is applied to the screen 37.

The latent image on the drum 47 is visualized or developed by a magnetic brush developer 48. The visualized image receives a post-charge through post charger 49 and then it is transferred to a conventional paper 50. The image on the paper 50 is fixed to complete the copied image. In FIG. 9, 52 is a roller for feeding conventional transferrable paper, 53 is a transfer roller, 54 is cleaning means and 55 is a corona discharger for eliminating the electrostatic latent image after transfer.

FIG. 10 shows another screen improving the screen shown in FIG. 1. As shown in FIG. 1, when the photoconductive layer 3 is provided in such a manner that only the conductive member 2 of the screen 1 exposed at one side surface of the screen, and when the charge at the openings will receive a strong image exposure, the resistance of the member 3 in the vicinity of the openings decreases and the charge will dissipate. Under this condition, when the secondary latent image is formed, the prevention of the ion flow is not sufficient, the foggy secondary latent image is obtained. This problem is solved by a screen shown in FIG. 10, in which the photoconductive member is provided at one side surface of the conductive member similar to that shown in FIG. 1, and in addition an insulating layer is formed at substantially the side surface of the conductive member corresponding to the opening or the vicinity thereof of the screen. In this improved screen, the conductive member is exposed at the location opposite to the side of the photoconductive layer. FIG. 10, (*a*), (*b*), (*c*) and (*d*) show the enlarged cross sections of the screen. The conductive member 57 in FIG. 10 (*a*) is made of a metallic plate by etching from one side thereof. The conductive member 61 of FIG. 10 (*b*) has a cross section shown therein when the plate is etched from both sides or electroplated or laser worked. FIG. 10 (*c*) and (*d*) show the conductive members 65 and 69 made of metallic fine wires. The photoconductive members 58, 62, 66 and 70 of the corresponding screens 56, 60, 64 and 68 are made of substances similar to that as explained with respect to FIG. 1. The insulating members 59, 63, 67 and 71 are made of organic material such as synthetic resin and inorganic material such as glass.

For preparing the screen, the conductive member having a good number of openings is used. For example, the fine glass fibres of 100 to 300 mesh are netted, the metallic plate is etched or electroplated. On one surface of the conductive member, the photoconductive substance is coated by spraying, or vacuum evaporation. On another side surface of the conductive member, the insulating material is spray coated and the insulating material is removed by discharge break down or heat melting or other means to expose the conductive member except the insulating material surrounding the side surfaces. Alternatively, the insulating material is coated on the whole surface of the conductive member and both surfaces thereof are abrased and then one surface thereof is coated with the photoconductive material. When the abrasion of the insulating material for exposing the conductive member is not sufficient it may be effective to put another conductive member on the insulating material.

By constituting the vicinity of the openings of the screen with the insulating member, whicih is not photoconductive material, charges due to precharge will not dissipate by a strong image exposure. In comparing the charges on the photoconductive member under the state of insulation and the charges on the insulating member, the latter charges are only slightly affected by the application of the corona ion. In other words, when the secondary electrostatic latent image is formed, foggy conditions are very effectively removed in the case of the screen shown in FIG. 10.

The recording member 7 shown in FIGS. 1 through 3 has the conductive base 8 and teh chargeable layer 9 made in unison, but in practical point of view, it is a metallic plate coated with resin. However, an insulating thin layer of polyethylenetelephthalate or sufficiently dried conventional paper can be used as for the recording member. In case of using only the chargeable substance it is necessary to apply the bias field to this chargeable substance and it requires an electrode. For visualizing the secondary latent image, wet type or dry type developer is used, but when a spraying form of ink is passed between the screen and the recording member, the secondary latent image is formed and the visualized image is simultaneously formed on the recording member with the aid of the collecting action of the modified ion flow.

We claim:

1. An electrophotographic process for forming an electrostatic latent image in accordance with a light image applied to a photosensitive member, said process comprising;

applying a uniform charge of predetermined polarity to a photosensitive screen which includes a conductive base member having a plurality of fine openings therein, and having a photoconductive material covering one side of the conductive base member and covering the inner peripheries of said openings, wherein the other side of the conductive base member is uncovered, and wherein the application of said charge is performed in the absence of light to charge the side of the screen bearing said photoconductive material;

exposing the screen to image light to form a primary electrostatic latent image thereon, wherein said photoconductive material at said one side and at said inner peripheries is charged in the vicinity of dark areas of the light image, and only said photoconductive material at said inner peripheries is charged in the vicinity of light areas of the light image; and applying an ion flow from said other side of said photosensitive screen after the primary latent image is formed thereon, wherein said ion flow is applied from a source having a polarity opposite to that of said electrostatic latent image, and simultaneously applying an electric field between the ion flow source and said photosensitive screen in a direction to cause said ions to flow from the ion flow source to said screen, thereby to modulate the ion flow in accordance with the pattern of the image formed on the screen.

2. A process according to claim 1 wherein said charge and said exposure are applied from said one side of the screen.

3. A process according to claim 2, wherein the step of applying an ion flow is performed by providing an ion source at said other side of the screen, and further comprising the steps of providing a chargeable member at said one side of the screen, and applying an electric field in a direction to cause the ions to flow from the ion source to the chargeable member, whereby a secondary electrostatic latent image is formed on the chargeable member by the ion flow modulated through said screen.

4. A process according to claim 3, further comprising the step of developing the secondary latent image.

5. An electrophotographic process for forming an electrostatic latent image in accordance with a light image applied to a photosensitive member, said process comprising;

applying a uniform charge of predetermined polarity to a photosensitive screen which includes a conductive base member having a plurality of fine openings therein, and having a photoconductive material covering one side of the conductive base member and covering the inner peripheries of said openings, wherein the other side of the conductive base member is uncovered and wherein the application of said charge is performed in the absence of light to charge the side of the screen bearing said photoconducitve material;

exposing the screen to image light to form a primary electrostatic latent image thereon, wherein said photoconductive material at said one side and at said inner peripheries is charged in the vicinity of dark areas of the light image, and only said photoconductive material at said inner peripheries is charged in the vicinity of light areas of the light image;

providing an ion flow source at said other side of the screen and a chargeable member at said one side of the screen; and applying an electric field in a direction to cause the ions to flow from the ion flow source to the chargeable member, whereby a secondary electrostatic latent image is formed on the chargeable member by the ion flow modulated through said screen.

6. A process according to claim 5, wherein the ion flow from the ion flow source is an alternating ion flow, and the electric field is applied between said screen and the chargeable member so as to cause the ions, having a polarity opposite to that of said electrostatic latent image on said screen, to flow to the chargeable member, thereby to form a positive secondary latent image on the chargeable member.

7. A process according to claim 6, further comprising, the step of developing the secondary latent image.

8. An electrophotographic process for forming an electrostatic latent image in accordance with a light image applied to a photosensitive member, said process comprising:

applying a charge of predetermined polarity to a photosensitive screen which includes a conductive base member having a plurality of fine openings therein, and having a photoconductive material covering one side of the conductive base member and covering the inner peripheries of said openings, wherein the other side of the conductive base member is uncovered, and wherein the application of said charge is performed to charge the side of the screen bearing said photoconductive material;

exposing the said one side of the screen to image light to form a primary electrostatic latent image thereon;

disposing a chargeable member in face-to-face relation with said one side of said screen; and applying an ion flow through said photosensitive screen after the latent image is formed thereon, from the side of the screen where the base member is exposed, to the chargeable member, wherein the ion flow is modulated in accordance with the pattern of the image formed on the screen to form a secondary electrostatic latent image on the chargeable member.

9. An electrophotographic process for forming an electrostatic latent image in accordance with a light image applied to a photosensitive member, said process comprising;

applying a charge of predetermined polarity to a photosensitive screen which includes a conductive base member having a plurality of fine openings therein, and having a photoconductive material covering one side of the conductive base member and an insulating material covering the inner peripheries of said openings, wherein the other side of the conductive base member is uncovered, and wherein the application of said charge is performed in the absence of light and from said one side of the screen to charge the side of the screen bearing said photoconductive material; and exposing the screen to image light from said one side thereof to form a primary electrostatic latent image thereon, wherein said photoconductive material at said one side and said insulating material at said inner peripheries are charged in the vicinity of dark areas of the light image, and only said insulating material at said inner peripheries is charged in the vicinity of light areas of the light image; and applying an ion flow from said other side of said photosensitive screen after the primary latent image is formed thereon, wherein said ion flow is applied from a source having a polarity opposite to that of said electrostatic latent image, and simultaneously applying an electric field between the ion flow source and said photosensitive screen in a direction to cause said ions to flow from the ion flow source to said screen, thereby to modulate the ion flow in accordance with the pattern of the image formed on the screen.

10. An electrophotographic process for forming an electrostatic latent image in accordance with a light image applied to a photosensitive member, said process comprising;

applying a charge of predetermined polarity to a photosensitive screen which includes a conductive base member having a plurality of fine openings therein, and having a photoconductive material covering one side of the conductive base member and an insulating material covering the inner peripheries of said openings, wherein the other side of the conductive base member is uncovered, and wherein the application of said charge is performed in the absence of light and from said one side of the screen to charge the side of the screen bearing said photoconductive material; and exposing the screen to image light from said one side thereof to form a primary electrostatic latent image thereon, wherein said photoconductive material at said one side and said insulating material at said inner peripheries are charged in the vicinity of light areas of the light image, and only said insulating material at said inner peripheries is charged in the vicinity of light areas of the light image;

applying an ion flow through said screen by providing an ion flow source at said other side of the screen, providing a chargeable member at said one side of the screen; and applying an electric field between said screen and the chargeable member in a direction to cause ions, having a polarity opposite to that of the electrostatic latent image, to flow to the chargeable member, whereby a secondary electrostatic latent image is formed on the chargeable member by ion flow modulated through said screen.

11. A process according to claim 10, further comprising the step of developing the secondary latent image.

* * * * *

UNITED STATES PATENT AND TRADEMARK OFFICE

CERTIFICATE OF CORRECTION

PATENT NO. : 3,976,484

DATED : August 24, 1976

INVENTOR(S) : YUJIRO ANDO, KATSUNOBU OHARA, and KEIJI TANAKA

It is certified that error appears in the above-identified patent and that said Letters Patent are hereby corrected as shown below:

Column 2, line 11, delete "on" and insert --ion--.

Column 3, line 51, delete "13" and insert --3--.

Column 4, line 52, delete "as" (first occurrence).

Column 4, line 63, delete "according" and insert --recording--.

Column 5, line 35, delete "ion" and insert --and ions--, and after "member" insert --2--.

Column 8, line 55, change "whicih" to --which--.

Column 8, line 66, change "teh" to --the--.

Claim 10, Column 12, line 17, delete "light" and insert --dark--.

Claim 9, Column 11, line 25, delete "teneously" and insert --taneously--.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*